US010429879B1

(12) United States Patent
Coimbra

(10) Patent No.: US 10,429,879 B1
(45) Date of Patent: Oct. 1, 2019

(54) BANDGAP REFERENCE VOLTAGE CIRCUITRY

(71) Applicant: NXP USA, Inc., Austin, TX (US)

(72) Inventor: Ricardo Pureza Coimbra, Campinas (BR)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 16/209,523

(22) Filed: Dec. 4, 2018

(51) Int. Cl.
*G05F 3/00* (2006.01)
*G05F 3/26* (2006.01)

(52) U.S. Cl.
CPC ..... *G05F 3/265* (2013.01)

(58) Field of Classification Search
CPC ..... G05F 3/265
See application file for complete search history.

(56) References Cited

U.S. PATENT DOCUMENTS 5,325,045 A 6/1994 Sundby
6,674,185 B2 1/2004 Mizuta
7,880,528 B2 2/2011 Igarashi
8,400,213 B2 3/2013 Sicard
9,110,485 B2 8/2015 Sicard
2011/0001546 A1 1/2011 Guo et al.
2013/0241523 A1* 9/2013 Youssefi ..... G05F 3/30 323/313

OTHER PUBLICATIONS

U.S. Appl. No. 15/209,503, "Temperature Detection Circuitry,", filed Dec. 4, 2018, 41 pages.

* cited by examiner

*Primary Examiner* — Adolf D Berhane
*Assistant Examiner* — Afework S Demisse
(74) *Attorney, Agent, or Firm* — Senaida B. San Miguel

(57) ABSTRACT

An embodiment for bandgap reference voltage circuitry includes: a bandgap reference voltage generator including: a first bipolar junction transistor (BJT); a first amplifier having a non-inverting input coupled to a collector of the first BJT and a first output node configured to provide a bandgap reference voltage; a first resistor coupled between a base of the first BJT and the first output node; a second BJT; a second amplifier having a non-inverting input coupled to a collector of the second BJT and a second output node coupled to a junction node; a second resistor coupled between a base of the second BJT and the junction node; and a third resistor coupled between the base of the first BJT and the junction node.

21 Claims, 4 Drawing Sheets

BANDGAP REFERENCE VOLTAGE CIRCUITRY

FIELD

This disclosure relates generally to bandgap reference voltage circuitry, and more specifically, to improved accuracy in bandgap reference voltage circuitry.

RELATED ART

Bandgap reference voltages are extensively used in microelectronic products, such as microcontroller products to generate input reference levels of power regulators. Conventionally, bandgap reference voltage generators are able to provide high accuracy by requiring a relatively high area cost, a part-to-part calibration at a relatively high test cost, or both.

BRIEF DESCRIPTION OF THE DRAWINGS

The present invention may be better understood, and its numerous objects, features, and advantages made apparent to those skilled in the art by referencing the accompanying drawings.

The present invention is illustrated by way of example and is not limited by the accompanying figures, in which like references indicate similar elements, unless otherwise noted. Elements in the figures are illustrated for simplicity and clarity and have not necessarily been drawn to scale.

DETAILED DESCRIPTION

Figure 1:
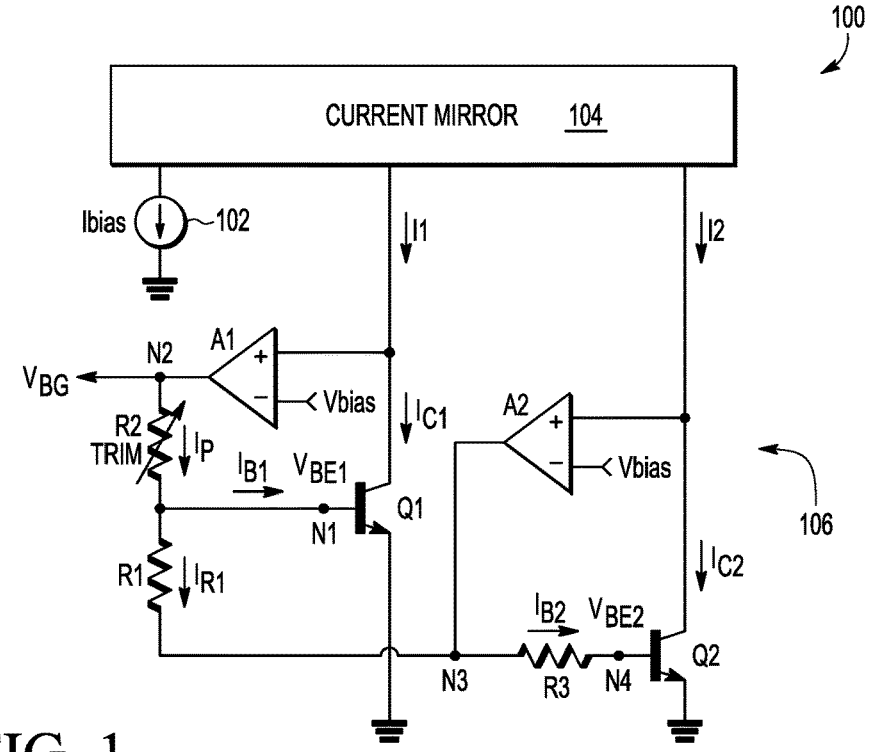
FIGS. 1, 2, 3, and 4 illustrate block diagrams depicting various examples of bandgap reference voltage circuitry, according to some embodiments of the present disclosure.

The following sets forth a detailed description of various embodiments intended to be illustrative of the invention and should not be taken to be limiting.

Overview

The present disclosure described herein provides bandgap reference voltage circuitry integrated on a die that utilizes a compact circuit arrangement with low area cost and provides accurate bandgap reference voltage generation even without calibration. However, a single-temperature calibration (e.g., at room temperature) may be employed to achieve even higher accuracy. The bandgap reference voltage circuitry utilizes bipolar junction transistors (BJTs) to generate temperature-related signals that are combined into a bandgap reference voltage that is constant over changing temperatures. The bandgap reference voltage is generated based in part on a resistance ratio implemented in the bandgap reference voltage circuitry. The resistance ratio may be implemented by a resistor divider, part of which may be implemented using a network of switches and resistors, which may be controlled by a finite state machine, in some embodiments.

The bandgap reference voltage circuitry may also include current-providing circuitry for providing one or more bias currents, one or more bias voltages, or both, to components of the bandgap reference voltage circuitry. In some embodiments, the bandgap reference voltage circuitry may be implemented as part of a system-on-chip (SoC), where the current-providing circuitry couples components of the bandgap reference voltage circuitry (such as the BJTs) to one or more dedicated current generators or one or more dedicated voltage sources on the SoC. If the dedicated current generators or dedicated voltage sources on the SoC are not accurate enough, the current-providing circuitry may also implement self-biasing capabilities that generate accurate and well-controlled bias currents or bias voltages for use by the bandgap reference voltage circuitry. For example, a first current and a second current are respectively provided to a first BJT and a second BJT of the bandgap reference voltage circuitry, where the first and second currents are generally provided according to a known ratio between two integer numbers, which may result in an integer N ratio (e.g., N:1) or N may be a fractional ratio. In some embodiments, current-providing circuitry may include circuit components to generate bias currents or bias voltages that are well-controlled to a desired ratio in an accurate and stable manner, rather than relying on dedicated current generators or voltage sources that may not provide the necessary accuracy or stability required by the bandgap reference voltage circuitry in some applications.

The bandgap reference voltage circuitry also minimizes sensitivity to various error sources, such as BJT base current effects (e.g., mismatch in current gain 1) and MOSFET (metal-oxide-semiconductor field-effect-transistor) device mismatch, where MOSFETs may be used within the bandgap reference voltage circuitry to implement stages for an amplifier. Based on the configuration of the bandgap reference voltage circuitry, the sensitivity to MOSFET mismatch is greatly attenuated and small sized MOSFETs may be used, which aid in a compact arrangement with low area cost.

For applications that require higher accuracy, single temperature calibration may be performed to trim the resistance ratio, which adjusts the level of the generated bandgap reference voltage by adjusting the resistance value of the resistor network. The single temperature calibration may be implemented at any known temperature, such as at room temperature.

Example Embodiments

FIGS. 1, 2, 3, and 4 each show a respective example of bandgap reference voltage circuitry that may be implemented as an integrated circuit. An integrated circuit and any circuitry described herein may be implemented in a semiconductor substrate, which can be any semiconductor material or combinations of materials, such as gallium arsenide, silicon germanium, silicon-on-insulator (SOI), silicon, monocrystalline silicon, the like, and combinations of the above. Each bottom portion of FIGS. 1, 2, 3, and 4 illustrates a similar circuitry arrangement 106, while each top portion of FIGS. 1, 2, 3, and 4 illustrates a different example of current-providing circuitry, as further discussed below. In some embodiments, the components of circuitry arrangement 106 are formed in a same substrate as the circuit(s) that uses a bandgap reference voltage that is being generated by the bandgap reference voltage circuitry.

FIG. 1 shows bandgap reference voltage circuitry 100 that includes circuitry arrangement 106, components of which include two bipolar junction transistors (BJTs) Q1 and Q2, three resistors R1, R2, and R3, and two amplifiers A1 and A2. Several nodes N1, N2, N3, and N4 are also labeled as reference points within circuitry arrangement 106. The circuitry arrangement 106 implements a first closed loop circuit branch that includes amplifier A1 and a second closed loop circuit branch that includes amplifier A2, which are coupled via resistor R1, as further discussed below. The first and second amplifiers A1 and A2 may each be implemented using an operational amplifier (op amp) or other suitable circuitry (e.g., one or more stages implemented using a number of MOSFETs). An op amp generally operates as an amplifier (e.g., amplifies an input signal) when connected in a closed loop (e.g., receives feedback).

The circuitry arrangement 106 also includes a bipolar junction transistor (BJT) in each circuit branch, labeled as Q1 in the first closed loop circuit branch and Q2 in the second closed loop circuit branch. In the embodiment shown, Q1 and Q2 are NPN BJTs, but other types of suitable transistors may be utilized in other embodiments (e.g., PNP BJTs). Q1 and Q2 each have three terminals that correspond to the NPN doped regions formed in the substrate, which respectively are collector (C) terminal, base (B) terminal, and emitter (E) terminal. The base terminal acts as the control terminal of a BJT, while the collector and emitter terminals act as current terminals (where the emitter is identified by the outward pointing arrow), also respectively referred to herein as simply a base, a collector, and an emitter of a BJT. Q1 and Q2 are implemented with proportional B-E junction areas, where each are generally implemented by associating a number of unit BJT devices (e.g., one or more) in parallel, where the associated BJTs have same sized B-E junction areas and same sized B-C junction areas, and the number of unit BJT devices implemented in Q1 and Q2 need not be equal. However, because of process spread or fabrication abnormalities during formation of the BJT devices (e.g., unequal dopant concentration, unequal thickness of semiconductor layers, and the like), the BJT devices may have slightly different current gains B (beta) from part to part, which may affect the accuracy of the bandgap reference voltage circuitry 100. The present disclosure provides that circuitry arrangement 106 is configured to cancel out sensitivity to current gain p (relying on the generally good matching that exists between Q1 and Q2 beta values), which improves accuracy of the bandgap reference voltage circuitry, even without calibration. Current gain p cancellation is further discussed below.

In typical operation, Q1 and Q2 each have a respective collector voltage Vc, base voltage Vb, and emitter voltage Ve, where base-emitter voltage Vbe is the voltage drop measured across the base and emitter of the respective BJT, and collector-emitter voltage Vce is the voltage drop measured across the collector and emitter of the respective BJT. Q1 and Q2 begin conducting current when the respective Vbe is equal to or greater than a turn-on voltage of about 0.7V, where Q1 and Q2 conduct a collector current Ic, a base current Ib, and an emitter current Ie, where Ie=Ib+Ic. Q1 and Q2 may operate in saturation mode when the B-E junction and the B-C junction are both forward biased and Vce is approximately near 0V, in active mode when the B-E junction is forward biased and the B-C junction is reverse biased, or in cut-off mode when Vbe is less than the turn-on voltage and little to no current (e.g., leakage currents being non-zero) being conducted. Generally for a given base current Ib, $Ic<\beta \cdot Ib$ in saturation mode, reaching a maximum value $Ic=\beta \cdot Ib$ in active mode. A BJT may be operated as a switch, generally being controlled in saturation mode (e.g., "on") or cut-off mode (e.g., "off"). The BJT saturation voltage VceSat is the voltage drop measured across the collector and emitter of a BJT at the point where a further increase in base current Ib or voltage Vb does not result in a corresponding increase in collector current Ic. Ideally, VceSat is 0V, but practically, VceSat is considered to be 0.1V or 0.2V. Characteristics of the BJTs are temperature dependent, where current and voltage of the BJT may vary as temperature varies. For example, collector current Ic depends on the reverse saturation current Ico and base-emitter voltage Vbe. As temperature increases, the reverse saturation current Ico increases (due to more electron-hole pairs being thermally generated), which increases Ic. To maintain constant current Ic at changing temperatures, Vbe may be decreased by approximately 2 mV per 1° C. increase in temperature, and similarly increased by approximately 2 mV per 1° C. decrease in temperature.

The collector of Q1 is coupled to receive a first current I1 and the collector of Q2 is coupled to receive a second current I2, which may be provided by current-providing circuitry from one or more dedicated current generators available to bandgap reference voltage circuitry 100 (e.g., on a system-on-chip, integrated circuit, microcontroller system, and the like). Generally, currents I1 and I2 are provided at a known ratio, which may be a ratio between two integer numbers. In some embodiments, the bandgap reference voltage circuitry may be implemented as part of a system-on-chip (SoC). The SoC may include dedicated current generators or voltage sources (e.g., current generators configured to source or sink current, positive supply voltage rails like Vdd, and negative supply voltage rails like ground or Vss) that are well-controlled (e.g., current or voltage signals that are accurate to a known level and stable at that level over time), where well-controlled current generators may be used to successfully provide currents I1 and I2 at the known ratio. In such embodiments, the bandgap reference voltage circuitry includes current-providing circuitry, which couples or provides the well-controlled current or voltage signals to inputs of components in the bandgap reference voltage circuitry. In other embodiments, the SoC may include only one well-controlled current generator or voltage source, or the SoC may include current generators or voltage sources that are not well-controlled (e.g., not stable or not within the accuracy needed). In such embodiments, bandgap reference voltage circuitry includes current-providing circuitry configured to implement self-biasing capabilities to generate the necessary signals for bandgap reference voltage circuitry. For example, current-providing circuitry may be configured to generate well-controlled currents I1 and I2 at the known ratio based on one or more of the SoC's dedicated current or voltage sources, which may or may not be well-controlled. The self-biasing capability of bandgap reference voltage circuitry is also beneficial for applications where improved accuracy is required. Various examples of current-providing circuitry for providing or generating the first and second currents I1 and I2 are further discussed below.

The first closed loop circuit branch includes amplifier A1, BJT Q1, and resistor R2. Amplifier A1 has an output node N2. Resistor R2 is coupled between output node N2 and the base of Q1 (e.g., a first terminal of R2 is coupled to node N2 and a second terminal of R2 is coupled to node N1 at the base of Q1). The emitter of Q1 is coupled to ground or other negative supply voltage (e.g., Vss or the like). Amplifier A1 has an inverting input (identified by the minus sign) coupled to a bias voltage Vbias. Bias voltage Vbias may be set at any convenient level equal to or above BJT saturation voltage VceSat (e.g., Vbias may be set to a value or level in the range of 0.1V to 0.3V). The collector of Q1 is coupled to a non-inverting input (identified by the plus sign) of amplifier A1. Due to force of feedback, amplifier A1 produces an output node voltage that drives the base voltage of Q1 to bias Q1 to operate at a point where Q1's collector voltage Vc (or Vce since Q1's emitter is grounded) is equal to Vbias. At this bias point, Q1 also conducts collector current IC1 equal to current I1 (e.g., Q1 operates in active region).

The second closed loop circuit branch includes amplifier A2, BJT Q2, and resistors R1 and R3. The second closed loop circuit branch is coupled to the first closed loop circuit branch through resistor R1, which may also be considered a coupling resistor R1 between the closed loop circuit branches. Resistor R1 is coupled between the base of Q1 and a node N3 (e.g., a first terminal of R1 is coupled to node N1 and a second terminal of R1 is coupled to node N3). Resistor R3 is coupled between node N3 and the base of Q2 (e.g., a first terminal of R3 is coupled to node N3 and a second terminal of R3 is coupled to node N4 at the base of Q2). The emitter of Q2 is coupled to ground or other negative supply voltage. The collector of Q2 is coupled to a non-inverting (+) input of amplifier A2. Amplifier A2 also has an inverting (−) input coupled to bias voltage Vbias. In the embodiment shown, a same Vbias is provided to both inverting (−) inputs of amplifiers A1 and A2. In the embodiment shown in FIG. 2, the inverting (−) input of A2 is coupled to the collector of Q1, which shorts the inverting (−) input of A2 to the non-inverting (+) input of A1. However, in other embodiments, the inverting (−) input of A2 may be coupled to the bias voltage Vbias at the inverting (−) input at A1, since A1's input voltages at its inverting (−) and non-inverting (+) inputs match (e.g., both are equal to Vbias). Due to force of feedback, amplifier A2 is configured to produce an output node voltage that is coupled to node N3 that drives the base voltage of Q2 to bias Q2 to operate at a point where Q2's collector voltage Vc (or Vce since Q2's emitter is grounded) is equal to Vbias. At this bias point, Q2 also conducts collector current IC2 equal to current I2 (e.g., Q2 operates in active region). With both Q1 and Q2 operating in "on" positions, the output node voltage provided by amplifier A1 at node N2 is a bandgap reference voltage Vbg, which is a nearly constant voltage over temperature, as further discussed below.

Other currents present in circuitry arrangement 106 are also labeled, including currents IB1 and IB2, which are formed when Q1 and Q2 are turned on. Current IB2 passes through resistor R3, current IR1 passes through R1, and current Ip passes through R2. Current Ip is configured to be a PTAT current, as further discussed below.

Conventionally, NPN base-emitter voltage VBE behavior as a function of collector current Ic and absolute temperature T is expressed as Equation 1:

$$V_{BE}(I_C, T) = V_{g0} - (V_{g0} - V_{BEN})\left(\frac{T}{T_N}\right) + C(T) \quad \text{Eq. 1}$$

where TN is a reference value of temperature in Kelvin (E.g., 300K),

Vg0 is the bandgap voltage of silicon extrapolated from TN to OK,

C(T) is a non-linear term commonly referred to as the bandgap voltage "curvature", and VBEN is the base-emitter voltage produced at T=TN with IC=IN, which can be expressed as Equation 2:

$$V_{BEN}(I_C, A_E) = \left(\frac{kT_N}{q}\right)\ln\left(\frac{I_N}{A_E J_S}\right) \quad \text{Eq. 2}$$

where k is the Boltzmann constant, q is the elementary charge,

IN is a reference collector current value,

Ae is the BJT emitter area, and

Js is the BJT saturation density current.

It is noted that term C(T) represents a "curvature" term defined as zero at TN, where TN is normally chosen as a mid-point of the operating temperature range or as room temperature. Typically C(T) will only contribute a few millivolts (e.g., 3 mV) over a wide range of temperatures, which can be considered a negligible error compared to VBEN spread for most applications.

A bandgap reference voltage is normally generated by combining VBE1 and VBE2 voltages of Q1 and Q2, respectively, in the form of Equation 3:

$$V_{BG} = V_{BE1} + K\cdot(V_{BE1} - V_{BE2}) \quad \text{Eq. 3}$$

where K is a design constant.

Using Equation 2, the voltage difference ΔVBE between VBE1 and VBE2 can be written as Equation 4:

$$\Delta VBE = (V_{BE1} - V_{BE2}) = \left(\frac{kT}{q}\right)\ln\left(\frac{I_{N1}A_{E2}}{I_{N2}A_{E1}}\right) \quad \text{Eq. 4}$$

Substituting Equation 1 (ignoring C(T) term as negligible) and Equation 4 into Equation 3 results in Equation 5:

$$V_{BG} = V_{g0} - (V_{g0} - V_{BE1N})\left(\frac{T}{T_N}\right) + K\left(\left(\frac{kT}{q}\right)\ln\left(\frac{I_{N1}A_{E2}}{I_{N2}A_{E1}}\right)\right) \quad \text{Eq. 5}$$

To cancel thermal variation in the first order (e.g., cancel out first order effects of temperature dependence), design constant K is made equal to Equation 6:

$$K = \frac{(V_{g0} - V_{BE1N})}{T_N\left(\frac{k}{q}\right)\ln\left(\frac{I_{N1}A_{E2}}{I_{N2}A_{E1}}\right)} \quad \text{Eq. 6}$$

As a result, Equation 5 can be rewritten as Equation 7:

$$V_{BG} = V_{g0} \quad \text{Eq. 7}$$

It can be seen that the embodiment shown in FIG. 1 generates an output voltage Vbg equal (or substantially equal) to the bandgap voltage of silicon in an effective and compact circuit structure, while achieving low area cost. The minimum error added by the circuitry elements is such that the accuracy achieved depends mainly on the spread of the term VBE1N in Equation 5.

According to Kirchhoff's laws, a relationship between the circuit paths as viewed from node N1 through Q1 to ground and through Q2 to ground is described in Equation 8, which is used to determine current IR1 in Equation 9:

$$V_{BE1} = R_1 I_{R1} + R_3 I_{B2} + V_{BE2} \quad \text{Eq. 8}$$

$$\Rightarrow I_{R1} = \frac{\Delta V_{BE}}{R_1} - \frac{R_3}{R_1} I_{B2} \quad \text{Eq. 9}$$

where ΔVBE=VBE1−VBE2.

Similarly, a relationship between currents at node N1 is described in Equation 10, and classical equations that model BJT behavior are provided as Equation 11:

$$I_P = I_{R1} + I_{B1} \quad \text{Eq. 10}$$

$$I_{B1} = \frac{I_{C1}}{\beta_1}; I_{B2} = \frac{I_{C2}}{\beta_2} \quad \text{Eq. 11}$$

Using Equations 9 and 11, Equation 10 may be rewritten as Equation 12:

$$I_P = \frac{\Delta V_{BE}}{R_1} - \frac{R_3 I_{C2}}{R_1 \beta_2} + \frac{I_{C1}}{\beta_1} \quad \text{Eq. 12}$$

Currents IC1 and IC2 are chosen in a range of Ic where β is stable (e.g., β1=β2=β), where Ip may be rewritten as Equation 13:

$$I_P = \frac{\Delta V_{BE}}{R_1} + \frac{1}{\beta}\left(I_{C1} - \frac{R_3 I_{C2}}{R_1}\right) \quad \text{Eq. 13}$$

In order to make Ip independent of current gain β, current gain β is cancelled out of Equation 13 by making R3=R1 (IC1/IC2), rewritten as Equation 14 (including ΔVBE from Eq. 4):

$$I_P = \frac{\Delta V_{BE}}{R_1} = \left(\frac{kT}{R1q}\right)\ln\left(\frac{I_{N1} A_{E2}}{I_{N2} A_{E1}}\right) \quad \text{Eq. 14}$$

The term ΔVBE in Equation 14 depends on physical constants and on current and area ratios, which can be precisely set. Typically, Ip spread is usually dominated by R1 resistance spread, which is often an optimal case without requiring trimming.

Bandgap reference voltage Vbg can also be determined, based on the circuit path viewed from node N2 through Q1 to ground described in Equation 15. Using Equation 14, Vbg may also be expressed as Equation 16:

$$V_{BG} = V_{BE1} + R_2 I_P \quad \text{Eq. 15}$$

$$V_{BG} = V_{BE1} + \frac{R_2}{R_1}(V_{BE1} - V_{BE2}) \quad \text{Eq. 16}$$

VBE1 has a negative thermal coefficient (e.g., VBE typically changes at a rate approximately −2 mV/° C. in silicon) and (R2/R1)·ΔVBE has a positive thermal coefficient adjusted appropriately through the gain term (R2/R1). By setting or trimming R2/R1 ratio so that Vbg is equal to the silicon bandgap voltage at one temperature (e.g., room temperature), the circuitry arrangement 106 "regulates" Vbg to be equal to the silicon bandgap voltage at all temperatures.

Often, when circuit error contributions are negligible (e.g., from current source mismatch, and the like), accuracy of the bandgap reference voltage circuitry is limited by process spread in Q1 global parameters that affect VBE1N. Since sensitivity to Q1 and Q2 base currents is cancelled out by setting appropriate ratios between resistances, signal conditioning mainly relies on the good matching figures of integrated resistors, which can be adjusted to the levels required at a relatively small area cost. Q1 and Q2 generate temperature-related signals and at the same time serve as amplifier devices. It is noted that the offsets from A1 and A2 will have negligible effect on accuracy because of the large gain between BJT base terminals and collector terminals and large voltage drops across resistances (e.g., sensitivity to MOSFET mismatch is minimized). In this sense, the BJTs act both as temperature-related signal generators and as first-stage gain devices, which greatly relaxes A1 and A2 offset requirements, where consequently, A1 and A2 may be built using relatively small devices. Also, it is noted that Vbg is regulated by A1 at a low impedance node. A1 may be designed with appropriate driving capability to drive various types of loads (e.g., capacitive or resistive) and may therefore function as a regulator.

The circuitry arrangement 106, including its configuration and operation, as described above is generally applicable for the other embodiments described herein with variations. It is noted that the accuracy of the embodiment shown in FIG. 1 relies on well controlled I2 magnitude and (I1/I2) ratio, which may be generated by dedicated sources on the SoC or may be generated by self-biasing capabilities of the current-providing circuitry utilizing local matched resistors R4 and R5 to implement the well-controlled I1/I2 ratio, as further discussed below. Utilizing current sources or mirrors based on resistors R4 and R5 may allow even smaller area usage than compared with using conventional MOSFET-based current sources or mirrors. If improved accuracy is required (or lower area cost is required), a single temperature calibration would improve accuracy limited by VBE1 intrinsic curvature by implementing R2 as a programmable resistor to trim or fine-tune the (R2/R1) gain ratio, even with the presence of process spread in R2 values. A programmable resistor may be used as R2 in all embodiments discussed herein, which has a configurable resistive value that may be selected from a number of available resistive values, such as in an array of resistors, as further discussed below.

Returning to FIG. 1, bandgap reference voltage circuitry 100 includes circuitry arrangement 106 shown in the bottom portion of the drawing, and current-providing circuitry shown in the top portion of the drawing, which includes current mirror 104 in the embodiment shown. Current mirror 104 is coupled to a current generator 102, which may be a dedicated current generator on an SoC that is configured to source or sink a stable and accurate current Ibias, in some embodiments. Current mirror 104 is connected to the collectors of Q1 and Q2 of circuitry arrangement 106 and is configured to generate currents I1 and I2 based on Ibias. While current mirror 104 may implement some ratio of I1 to I2, the desired known ratio N, which may be an integer or fractional ratio, may be achieved by also adjusting a ratio of Q1 and Q2 current densities (or Jc=Ic/Ae), meaning that BJT areas of Q1 and Q2 may be adjusted (e.g., Q2 may be designed to include more unit BJT devices than Q1) to achieve the desired known ratio N. For example, even when I1 is equal to I2 (e.g., 1:1) the ratio of AE2/AE1 still remains to implement the desired ratio N.

Figure 2:
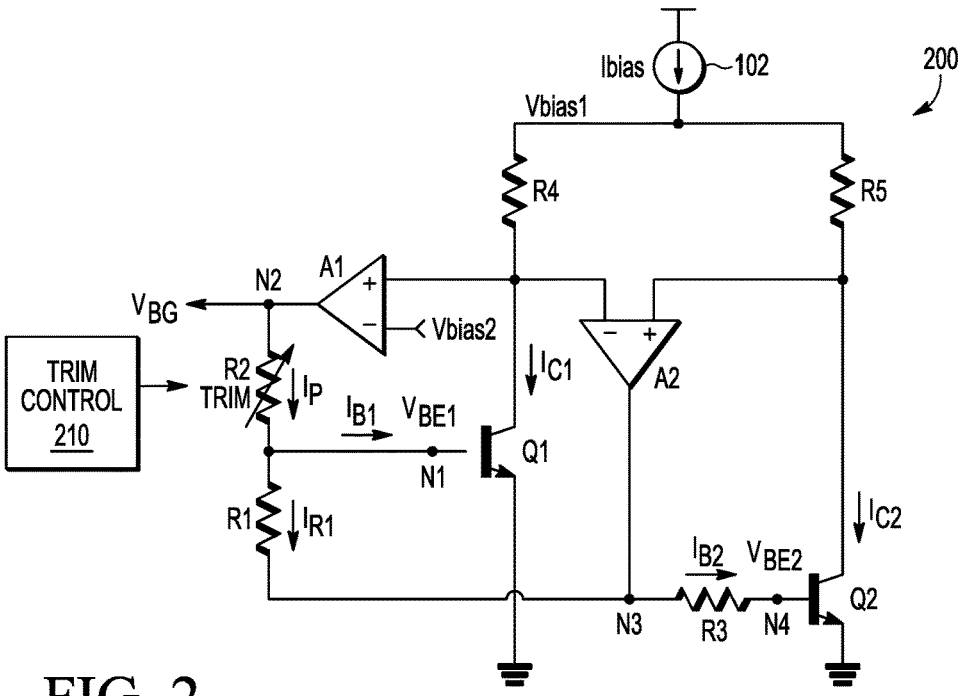

FIG. 2 illustrates bandgap reference voltage circuitry 200 that includes circuitry arrangement 106 shown in the bottom portion of the drawing, and current-providing circuitry shown in the top portion of the drawing, which includes a pair of resistors R4 and R5. The pair of resistors R4 and R5 have resistive values that are configured to convert I1 and I2 into voltages driven into the amplifier A2 that become matched due to force of feedback. The desired known ratio may be achieved by adjusting the ratio of Q1 and Q2 current densities, adjusting the ratio of I1 and I2 based on Ibias by adjusting the ratio between R4 and R5, or both. Resistors R4 and R5 are coupled between respective collectors of Q1 and Q2 and an output of the current generator 102 (e.g., R4 has a first terminal coupled to the output of generator 102 and a second terminal coupled to the collector of Q1, and R5 has a first terminal tied to R4's first terminal and the output of generator 102 and a second terminal coupled to the collector of Q2). In the embodiment shown, current generator 102 is also coupled to a positive supply voltage, such as Vdd, where some voltage Vbias1 results at the tied terminals of R4 and R5 (e.g., the "tied terminals" of R4 and R5 being the first terminals of R4 and R5 that are connected).

At room temperature, Q1 conducts collector current IC1 equal to I1 and Q2 conducts collector current IC2 equal to 12, where Q1 and Q2 both have a collector voltage equal to Vbias2 (which is equivalent to Vbias as discussed above in connection with FIG. 1). According to Kirchhoff's laws, a relationship between the circuit paths through R4 and R5 is described in Equations 17:

$$R_4 I_1 = R_5 I_2 = V_{bias1} - V_{bias2} \quad \text{Eq. 17}$$

which may be rewritten to express I1 as Equation 18 and 12 as Equation 19:

$$I_1 = \frac{V_{bias1} - V_{bias2}}{R_4} = \left(\frac{R_5}{R_4 + R_5}\right) I_{BIAS} \quad \text{Eq. 18}$$

$$I_2 = \frac{V_{bias1} - V_{bias2}}{R_5} = \left(\frac{R_4}{R_4 + R_5}\right) I_{BIAS} \quad \text{Eq. 19}$$

The ratio of I1 to I2 of Equations 18 and 19 may be provided as Equation 20:

$$\frac{I_1}{I_2} = \frac{R_5}{R_4} \quad \text{Eq. 20}$$

It can be seen that when I1 is equal to N times I2 to achieve a ratio of N, resistor R5 being equal to N times R4 causes Q1 and Q2 collector voltages to match.

Trim control 210 may be implemented as a finite state machine that selects one resistive value from a plurality of possible resistive values that may be implemented by programmable resistor R2. Trim control 210 provides some M-bit amount of resolution, such as M=6 bits of resolution that provides 2^n or 64 possible selections. Each possible selection is associated with a resistive value that corresponds to an adjustment of the gain ratio R2/R1, which compensates or adjusts the positive thermal coefficient of (R2/R1) ΔVBE to offset the negative thermal coefficient of VBE1. This compensation trims bandgap reference voltage Vbg to the silicon bandgap voltage (e.g., increasing or decreasing Vbg based on increasing or decreasing the selected resistive value). A greater number of possible resistance selections allows for finer control over the gain ratio, allowing the bandgap voltage Vbg to be fine-tuned, such as by millivolts or microvolts based on the resistive value selected. For example, R2 may be adjustable over a range of possible resistance values, where the range is divided into a number of steps, one step for each possible change in Vbg value, or ΔVbg. Resolution may be increased by using a larger value of M. In some embodiments, trim control 210 may also include a memory that stores a table or other data structure (e.g., a register) that indicates one or more selections for one or more initial resistive values that correspond to the desired R2/R1 ratio. For example, a table may store all possible selections and their associated resistive value, where each resistive value corresponds to a different change in Vbg value. An initial resistive value can be selected and programmed, with the option to further calibrate the gain ratio, if needed. In another example, a register may store a single selection as a pre-programmed initial resistive value, with the option to further calibrate the gain ratio, if needed. Programmable resistor R2 is further discussed below in connection with FIG. 5.

Figure 5:
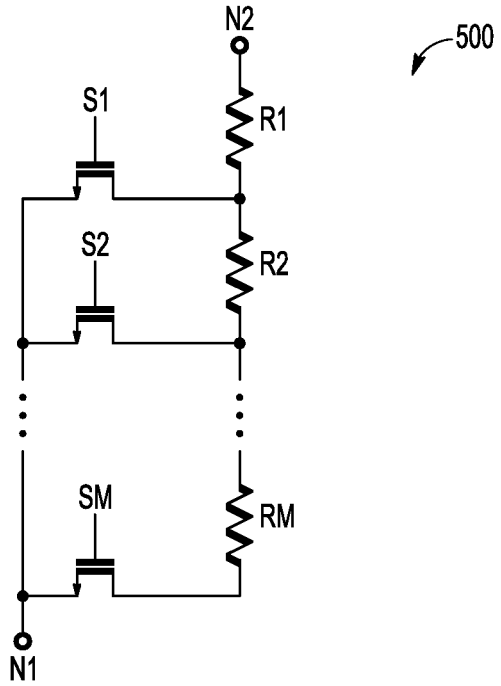
FIG. 5 illustrates a block diagram depicting an example programmable resistor that may be implemented in bandgap reference voltage circuitry, according to some embodiments of the present disclosure.

FIG. 5 shows an example programmable resistor 500 that may be implemented in various embodiments of the bandgap reference voltage circuitry discussed herein. Programmable resistor 500 is an array 500 of resistors that may be utilized as R2 to trim the gain ratio, in order to calibrate or fine tune the bandgap reference voltage circuitry for improved accuracy (e.g., adjust Vbg in range of +/−10 mV).

In the example shown, array 500 includes an M number of resistors R connected in series as a column from 1 to M, M being an integer of two or greater. The first resistor R1 of the column of resistors has a first terminal coupled to node N2 (shown at the top of FIG. 5). An overall resistive value of the array 500 is a combination of the individual resistance values of one or more selected resistors R. Array 500 is programmable over a plurality of different resistive values that are implemented by different combinations of resistance values of selected resistors within the array. Each resistor has a first terminal shown as a top terminal and a second terminal shown as a bottom terminal, where "top" and "bottom" are simply used in reference to FIG. 5. In some embodiments, each resistor R may have a same (uniform) resistance value, such as to implement uniform incremental steps through a range of possible resistive values. In other embodiments, resistors R may have different resistance values (e.g., different sized resistors), such as to perform quick tuning by using large resistors to quickly step to an estimated resistive value corresponding to a desired gain ratio (e.g., using resistors R1, R10, R20, etc., for large stepping), with the option of performing fine tuning by using smaller resistors (interspersed between the large resistors in the column of resistors such as resistors R2-R9, R11-R19, etc.) for more precise calibration. Additional resistors or different arrangements of resistors, such as in an N row by M column arrangement, where resistors may be connected in series, in parallel, or in both series and parallel, may be implemented in array 500 in other embodiments. For example, a binary-weighted resistor array may be implemented in other embodiments.

In the example shown, array 500 also includes an M number of switches S, which are implemented using NMOS (or N-type metal-oxide-semiconductor) transistors, although other types of switching elements may be used in other embodiments (e.g., PMOS, or other suitable types of transistors or switching devices). Additional switches, fewer switches, or different arrangements of switches (such as for an N×M array) may be included in array 1000 in other embodiments. Each switch S has a control terminal coupled to a respective control signal output by trim control circuit 210, which either opens or closes the respective switch. Each switch S has a first current terminal connected to node N2 (shown at the bottom of FIG. 5), and a second current terminal connected to the second terminal of a respective resistor R. For example, switch S1 couples the second terminal of R1 to ground, while switch SM couples the second terminal of RM to ground. In the embodiment shown, trim control circuit 210 is configured to select one or more series-connected resistors by closing the selected switch S of the last series-connected resistor to be selected. For example, to select the combination of resistors that include R1 and R2, trim control 210 closes switch S2. To select the combination of resistors that include R1 through Rx, trim control 210 closes switch Sx, up to and including the entire array (or SM). Trim control circuit 210 is also configured to open the unselected switches S by applying appropriate control signals.

Figure 3:
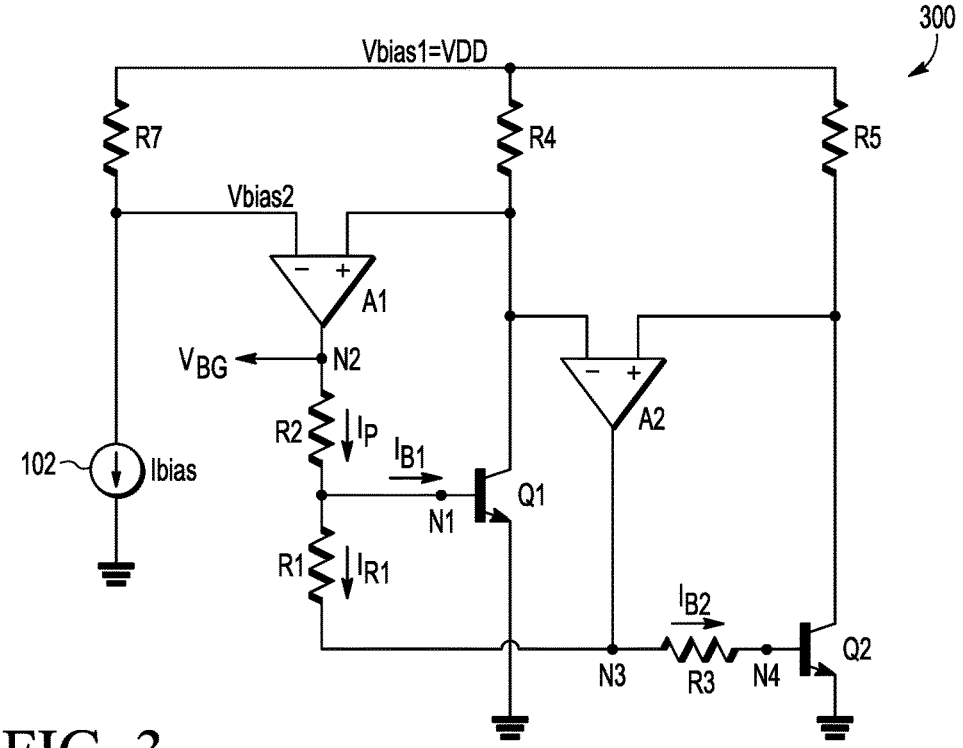

FIG. 3 illustrates bandgap reference voltage circuitry 300 that includes circuitry arrangement 106 in the bottom portion of the drawing and current-providing circuitry in the top portion of the drawing. Current-providing circuitry includes a pair of resistors R4 and R5 respectively connected to the collectors of Q1 and Q2. The tied terminals of R4 and R5 are coupled to a positive supply voltage, such as Vdd, as Vbias1. A bias resistor R7 is also coupled between the Vbias2 input of amplifier A1 and the tied terminals of R4 and R5 (e.g., R7 has a first terminal coupled to the first terminals of R4 and R5, and a second terminal coupled to the Vbias2 input of A1). A current generator 102 is also coupled between the bias resistor R7 and ground (e.g., the second terminal of R7 is also coupled to current generator 102). In the embodiment shown, current generator 102 sinks a current Ibias through resistor R7. The resistive value of R7 may also be configured to provide the desired Vbias2 based on Vbias1 (or Vdd), where Vbias2 is equivalent to Vbias as discussed above in connection with FIG. 1.

The effect of amplifier A2's offset in the (I1/I2) ratio is strongly attenuated by the voltage drop across the resistors R4 and R5. For example, consider A2's input offset modeled as a voltage source Voff in series with its non-inverting (+) input. Currents I1 and I2 from Equations 18 and 19 can be expressed as Equations 21 and 22:

$$I_1 = \frac{V_{bias1} - V_{bias2} + Voff}{R_4} \quad \text{Eq. 21}$$

$$I_2 = \frac{V_{bias1} - V_{bias2}}{R_5} \quad \text{Eq. 22}$$

And the ratio of I1 to I2 may be provided as Equation 23:

$$\frac{I_2}{I_1} = \frac{R_5}{R_4}\left(1 + \frac{Voff}{V_{bias1} - V_{bias2}}\right) \quad \text{Eq. 23}$$

Viewing Equation 23, as long as Voff is much less than the voltage drop across the resistors R4 and R5 (which is equal to Vbias1-Vbias2), the effect of Voff on the current ratio (I1/I2) is negligible. It is also noted that a larger voltage drop across the resistors R4 and R5 translates into a larger tolerated value of Voff. These practical embodiments allow relaxed requirements for A2 offset and consequently, A2 can be implemented with relatively small devices.

Figure 4:
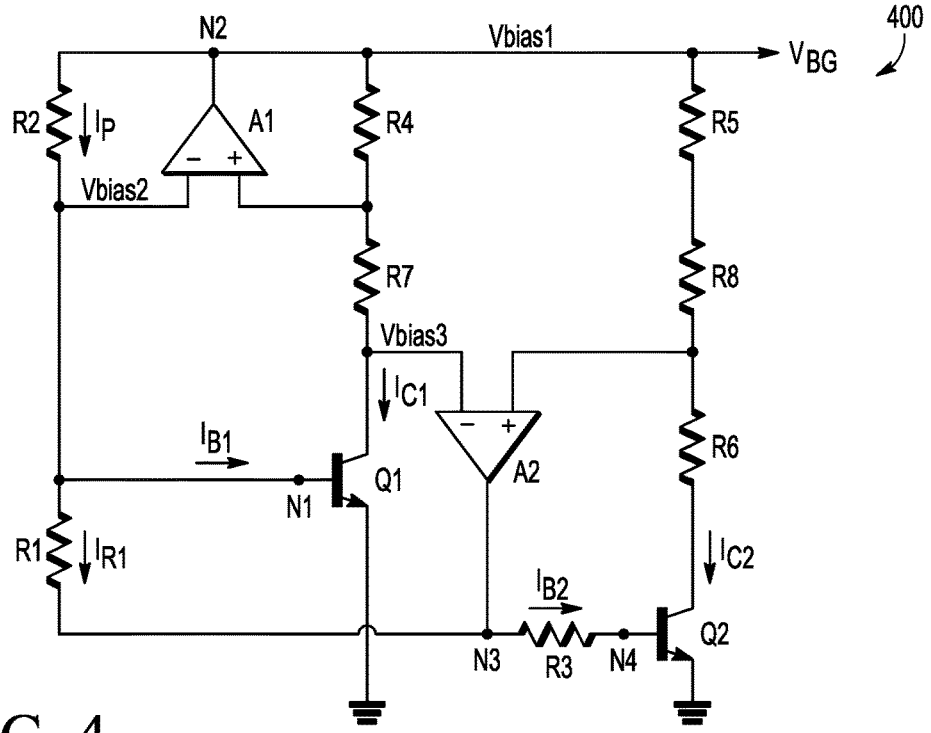

FIG. 4 illustrates bandgap reference voltage circuitry 400 that includes circuitry arrangement 106 in the bottom portion of the drawing and current-providing circuitry in the top portion of the drawing. In the embodiment shown, the inverting (−) input of A2 is coupled to Q1's collector, and the non-inverting (+) input of A2 is coupled to Q2's collector through resistor R6 (e.g., one terminal of R6 is coupled to A2's non-inverting (+) input and another terminal coupled to Q2's collector). The inverting (−) input of A1 is coupled to node N1 at the base of Q1, and the non-inverting (+) input of A1 is coupled to Q1's collector through resistor R7 (e.g., one terminal of R7 is coupled to A1's non-inverting (+) input and another terminal coupled to Q1's collector). Resistor R2 remains coupled between A1's output node N2 and the base of Q1 at N1, with PTAT current Ip passing through R2.

The embodiment shown also includes self-biasing current-providing circuitry based on PTAT current Ip (rather than Ibias or other dedicated current generator), which includes resistors R4 and R5 that are respectively coupled to Q1's collector and Q2's collector through one or more resistors. Resistors R4 and R5 have terminals tied to the output node of A1 (e.g., R4 and R5 each have a first terminal coupled to A1's output node). R4 is coupled to Q1's collector through R7 (e.g., R4's second terminal is coupled to R7's terminal at the non-inverting (+) input of A1). R5 is coupled to Q2's collector through R8 and further through R6 (e.g. R5's second terminal is coupled to one terminal of R8, where R8 has another terminal coupled to R6's terminal at the non-inverting (+) input of A2). Bandgap reference voltage Vbg serves as bias voltage Vbias1, and R2 is sized to produce Vbias2 at the inverting (−) input of A1, where Vbias2 is also present at the non-inverting (+) input of A1 due to force of feedback.

Ignoring resistors R7 and R8 for the moment and assuming second terminals of R4 and R5 are respectively coupled to A2's inverting and non-inverting inputs, resistors R2, R4, and R5 experience a same voltage drop of Vbias1-Vbias2 when the first closed loop drives Q1's base-emitter voltage VBE1 such that Q1 conducts collector current IC1 and the second closed loop drives Q2's base-emitter voltage VBE2 such that Q2 conducts collector current IC2, which can be expressed as the relationships in Equation 24:

$$R_2 I_P = R_4 I_{C1}; R_4 I_{C1} = R_5 I_{C2} \quad \text{Eq. 24}$$

Collector currents IC1 and IC2 may be respectively be determined from Equation 24 and written in Equation 25:

$$I_{C1} = \left(\frac{R_2}{R_4}\right) I_P;\ I_{C2} = \left(\frac{R_4}{R_5}\right) I_{C1} \quad \text{Eq. 25}$$

where IC2 may further be rewritten as Equation 26:

$$I_{C2} = \left(\frac{R_2}{R_5}\right) I_P \quad \text{Eq. 26}$$

As discussed above, Q1 and Q2 should be biased with collector currents within stable current gain (e.g., β1=β2=β), where Ip from Equation 13 may be combined with IC1 and IC2 expressions from Eq. 25 and 26 as Equation 27:

$$I_P = \frac{\Delta V_{BE}}{R_1} + \frac{1}{\beta}\left(\left(\frac{R_2}{R_4}\right) I_P - \frac{R_3}{R_1}\left(\frac{R_2}{R_5}\right) I_P\right) \quad \text{Eq. 27}$$

The resistances R1, R2, R4, and R5 may be factored out and may be rewritten as Equation 28:

$$I_P = \frac{\Delta V_{BE}}{R_1} + \frac{R_2 I_P}{R_1 R_4 R_5 \beta}(R_1 R_5 - R_3 R_4) \quad \text{Eq. 28}$$

In order to make Ip independent of current gain β, current gain β is cancelled out of Equation 28 by making R3=R1 R5/R4, resulting in a PTAT current Ip equivalent to Equation 14 provided above.

It is also noted that resistor R6 is sized to match Q1 and Q2 collector-base voltages (e.g., Vbc1=Vbc2) in order to cancel Early effects. While resistor R6 is shown in the embodiment in FIG. 4, R6 may be implemented in any of the embodiments of the present disclosure. Since the inputs of A2 are at a same voltage due to force of feedback, the voltages from A2's inverting (−) input through Q1 to ground and from A2's non-inverting (+) input through Q2 to ground may be described as Equation 29, which can be used to determine VBC1 in Equation 30:

$$-V_{BC1}+V_{BE1}=R_6I_{C2}-V_{BC2}+V_{BE2} \quad \text{Eq. 29}$$

$$-V_{BC1}=R_6I_2-V_{BC2}-(V_{BE1}-V_{BE2}) \quad \text{Eq. 30}$$

Using Equations 14 and 26, VBC1 may be expressed as Equation 31:

$$-V_{BC1} = R_6\left(\frac{R_2}{R_5}\right)\frac{\Delta V_{BE}}{R_1} - V_{BC2} - \Delta V_{BE} \quad \text{Eq. 31}$$

where ΔVBE=VBE1·VBE2. In order for VBC1 to equal VBC2, R6 is configured to be equal to R1·R5/R2, which cancels out the ΔVBE terms and minimizes sensitivity to Early effects.

Returning to FIG. 4, resistor R7 has been included between R4 and Q1's collector, and resistor R8 is included between R5 and R6. While resistors R7 and R8 are shown in the embodiment in FIG. 4, R7 and R8 may be implemented in any of the embodiments of the present disclosure to further reduce Vbg sensitivity to A2's offset. Resistors R4 and R5 introduce a first voltage drop from Vbias1 (or Vbg), and resistors R7 and R8 introduce a second voltage drop, where the inputs to A2 are equal to a bias voltage Vbias3 by force of feedback. The voltage drop across R4 and R7 is the same as the voltage drop across R5 and R8, which may be described as Equation 32:

$$(R_4+R_7)I_{C1}=(R_5+R_8)I_{C2} \quad \text{Eq. 32}$$

Using IC1 and IC2 from Equations 25 and 26, Equation 32 may be written as Equation 33, which can be simplified to Equation 34:

$$(R_4 + R_7)\left(\frac{R_2}{R_4}\right)I_P = (R_5 + R_8)\left(\frac{R_2}{R_5}\right)I_P \quad \text{Eq. 33}$$

$$\frac{R_7}{R_4} = \frac{R_8}{R_5} \quad \text{Eq. 34}$$

Or put another way, the ratio of R5 to R4 is equal to the ratio of R8 to R7.

Figure 6A:
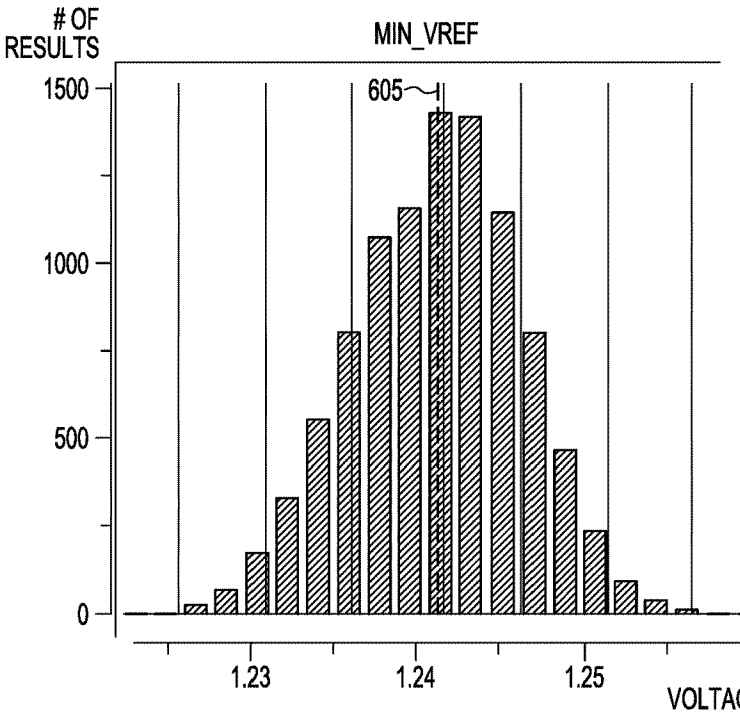
FIGS. 6A and 6B illustrate bar graphs depicting example test results for parameter spread of bandgap reference voltage circuitry, according to some embodiments of the present disclosure.
Figure 6B:
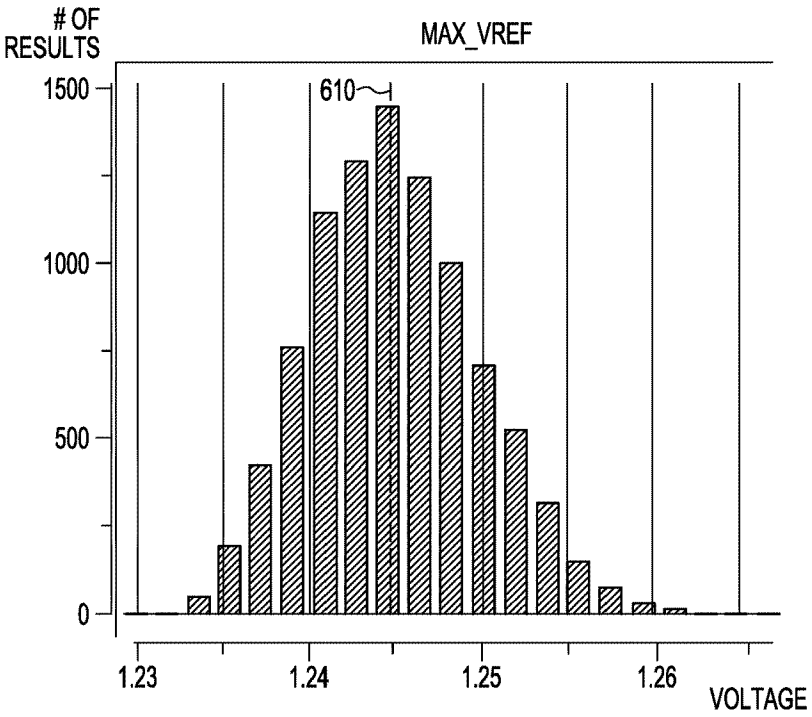

FIGS. 6A and 6B illustrate bar graphs depicting example test results for temperature spread of bandgap reference voltage circuitry. Monte Carlo simulation was performed on a circuit that implemented the embodiment of bandgap reference voltage circuitry shown in FIG. 4, with global and local parameter variations. DC temperature was swept from −40° C. to 125° C., without any calibration. The circuit was designed for a target area of 0.0012 $mm^2$. The results of 10,000 simulation runs are shown in FIGS. 6A and 6B.

Without any calibration, FIG. 6A shows minimum Vbg having a mean of 1.241V with +/−5.101 mV accuracy (e.g., standard deviation or sigma), and FIG. 6B shows maximum bandgap reference voltage Vbg having a mean of 1.245V with +/−4.943 mV accuracy. In both cases, sigma variation is dominated by Q1 global parameter (VBE1) spread, with secondary error source being resistor global variations (e.g., untrimmed resistance variations that affect Ic magnitude and consequently VBE1). These results indicate good accuracy obtained without calibration.

By now it should be appreciated that there has been provided bandgap reference voltage circuitry that utilizes bipolar junction transistors (BJTs) in a compact circuit arrangement that provides accurate bandgap reference voltage generation, based in part on a resistance ratio implemented in the bandgap reference voltage circuitry.

In one embodiment of the present disclosure, an integrated circuit for bandgap reference voltage generation is provided, which includes: a first closed loop circuit branch including: a first bipolar junction transistor (BJT) having a first collector configured to receive a first current and a first emitter coupled to ground, a first amplifier having a non-inverting input coupled to the first collector of the first BJT and a first output node configured to provide a bandgap reference voltage, and a first resistor having one terminal coupled to the first output node and another terminal coupled to a first base of the first BJT; and a second closed loop circuit branch including: a second BJT having a second collector configured to receive a second current and a second emitter coupled to ground, a second amplifier having a non-inverting input coupled to the second collector of the second BJT and a second output node coupled to a junction node, a second resistor having one terminal coupled to the junction node and another terminal coupled to a second base of the second BJT, and a third resistor having one terminal coupled to the first base of the first BJT and another terminal coupled to the junction node.

One aspect of the above embodiment provides that an inverting input of the first amplifier and an inverting input of the second amplifier are configured to receive a bias voltage.

Another aspect of the above embodiment provides that an inverting input of the second amplifier is coupled to the first collector of the first BJT.

Another aspect of the above embodiment provides that an inverting input of the first amplifier is coupled to the first base of the first BJT.

Another aspect of the above embodiment provides that the first resistor includes a programmable resistor configurable to adjust a level of the bandgap reference voltage provided by the first amplifier.

A further aspect of the above embodiment provides that the integrated circuit further includes: a state machine configured to select a particular resistive value of the programmable resistor, wherein the programmable resistor includes an array of resistors coupled to an array of programmable switches, the state machine is configured to select the particular resistive value from a plurality of resistive values by activation of one or more of the programmable switches, and each of the plurality of resistive values is associated with a respective bandgap reference voltage level provided by the first amplifier.

Another aspect of the above embodiment provides that a resistance value of the second resistor is configured to be equal to a resistive value of the third resistor multiplied by a ratio of the first current to the second current.

Another aspect of the above embodiment provides that a PTAT (proportional-to-absolute-temperature) current that flows through the first resistor is configured to be equal to a difference between a first base-emitter voltage of the first BJT and a second base-emitter voltage of the second BJT, divided by a resistive value of the third resistor.

Another aspect of the above embodiment provides that the bandgap reference voltage is configured to be equal to a difference term multiplied by a gain term, plus a first base-emitter voltage of the first BJT, wherein the difference term is equal to a difference between the first base-emitter voltage and a second base-emitter voltage of the second BJT, and the gain term is equal to a resistive value of the first resistor divided by a resistive value of the third resistor.

Another aspect of the above embodiment provides that the integrated circuit further includes: current-providing circuitry configured to provide the first and second currents, the current-providing circuitry including a fourth resistor having a first terminal coupled to the first collector of the first BJT and a fifth resistor having a first terminal coupled to the second collector of the second BJT, wherein second terminals of the fourth and fifth resistors are tied.

A further aspect of the above embodiment provides that a resistance value of the second resistor is configured to be equal to a resistive value of the third resistor multiplied by a ratio of the fifth resistor to the fourth resistor.

Another further aspect of the above embodiment provides that the second terminals of the fourth and fifth resistors are coupled to a bias voltage.

A still further aspect of the above embodiment provides that the integrated circuit is implemented as part of a system-on-chip (SOC), and the bias voltage is a power supply voltage on the SOC.

Another further aspect of the above embodiment provides that the current-providing circuitry further includes self-biasing circuitry configured to generate a bias voltage at an inverting input of the first amplifier, the self-biasing circuitry including a bias resistor having a first terminal coupled to the inverting input of the first amplifier and a second terminal coupled to the second terminals of the fourth and fifth resistors.

Another further aspect of the above embodiment provides that the non-inverting input of the second amplifier is coupled to the collector of the second BJT through a sixth resistor, wherein the sixth resistor is configured to be equal to a resistive value of the third resistor multiplied by a ratio of the fifth resistor to the first resistor.

Another further aspect of the above embodiment provides that the second terminals of the fourth and fifth resistors are tied to the first output node of the first amplifier, and the first amplifier has an inverting input coupled to the first base of the first BJT.

A still further aspect of the above embodiment provides that a first current at the first collector of the first BJT is configured to be equal to a PTAT (proportional-to-absolute-temperature) current that flows through the first resistor multiplied by a ratio of a resistive value of the first resistor to a resistive value of the fourth resistor, and a second current at the second collector of the second BJT is configured to be equal to the PTAT (proportional-to-absolute-temperature) current multiplied by a ratio of a resistive value of the first resistor to a resistive value of the fifth resistor.

Another still further aspect of the above embodiment provides that a seventh resistor is coupled between the non-inverting input of the first amplifier and the first collector of the first BJT, an eighth resistor is coupled between the fifth resistor and the non-inverting input of the second amplifier, a ratio of the fifth resistor to the fourth resistor is equal to a ratio of the eighth resistor to the seventh resistor.

In another embodiment of the present disclosure, an apparatus is provided, which includes: a bandgap reference voltage generator including: a first bipolar junction transistor (BJT) having a first collector configured to receive a first current and a first emitter coupled to ground; a first amplifier having a non-inverting input coupled to the first collector of the first BJT and a first output node configured to provide a bandgap reference voltage; a first resistor having one terminal coupled to a first base of the first BJT and another terminal coupled to the first output node; a second BJT having a second collector configured to receive a second current and a second emitter coupled to ground; a second amplifier having a non-inverting input coupled to the second collector of the second BJT and a second output node coupled to a junction node; a second resistor having one terminal coupled to a second base of the second BJT and another terminal coupled to the junction node; and a third resistor having one terminal coupled to the first base of the first BJT and another terminal coupled to a junction node.

One aspect of the above embodiment provides that the apparatus further includes a current-providing circuit to the bandgap reference voltage generator, wherein the current-providing circuit and the bandgap reference voltage generator are implemented as part of a system-on-chip (SOC), the current-providing circuit is coupled to one or more of a current source and a power rail voltage provided by the SOC, and the current-providing circuit is configured to provide the first and second currents to the bandgap reference voltage generator.

Another further aspect of the above embodiment provides that the first resistor includes a programmable resistor configurable to trim the bandgap reference voltage generator, and the apparatus further includes a state machine configured to select a particular resistive value of a plurality of resistive values implemented by the programmable resistor.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

The circuitry of bandgap reference voltage circuitry may be formed using a sequence of numerous process steps applied to a semiconductor wafer such as a silicon wafer, including but not limited to depositing semiconductor materials including dielectric materials and metals, such as growing, oxidizing, sputtering, and conformal depositing, etching semiconductor materials, such as using a wet etchant or a dry etchant, planarizing semiconductor materials, such as performing chemical mechanical polishing or planarization, performing photolithography for patterning, including depositing and removing photolithography masks or other photoresist materials, ion implantation, annealing, and the like. Examples of integrated circuit components implemented in such circuitry include but are not limited to a processor, memory, logic, analog circuitry, sensor, MEMS (microelectromechanical systems) device, standalone discrete devices such as resistors, inductors, capacitors, diodes, power transistors, and the like. In some embodiments, the active circuitry may be a combination of the integrated circuit components listed above or may be another type of microelectronic device.

In some embodiments, switches may be implemented using one or more transistors, such as n-channel or p-channel transistors, or other suitable switching devices. The switch control signals are each configured to open or close the respective switch (e.g., to close the switch by making it conductive and complete the path between the first and second terminals of the switch, or to open the switch by making the switch nonconductive and break the path between the first and second terminals of the switch).

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common mode).

The description herein refers to nodes or features being "connected" or "coupled" together. As used herein, unless expressly stated otherwise, "coupled" means that one node or feature is directly or indirectly joined to (or is in direct or indirect communication with) another node or feature, and not necessarily physically. As used herein, unless expressly stated otherwise, "connected" means that one node or feature is directly joined to (or is in direct communication with) another node of feature. For example, a switch may be "coupled to a plurality of nodes, but all of those nodes need not always be "connected" to each other; the switch may connect different nodes to each other depending upon the state of the switch. Furthermore, although the various schematics shown herein depict certain example arrangements of elements, additional intervening elements, devices, features, or components may be present in an actual embodiment (assuming that the functionality of the given circuit is not adversely affected).

Although the invention is described herein with reference to specific embodiments, various modifications and changes can be made without departing from the scope of the present invention as set forth in the claims below. For example, additional resistors may be implemented in FIG. 5. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

As used herein, the terms "substantial" and "substantially" mean sufficient to achieve the stated purpose or value in a practical manner, taking into account any minor imperfections or deviations, if any, that arise from usual and expected process abnormalities that may occur during wafer fabrication, which are not significant for the stated purpose or value. Also as used herein, the terms "approximately" and "about" mean a value close to or within an acceptable range of an indicated value, amount, or quality, which also includes the exact indicated value itself.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An integrated circuit for bandgap reference voltage generation comprising:

a first closed loop circuit branch comprising:

a first bipolar junction transistor (BJT) having a first collector configured to receive a first current and a first emitter coupled to ground, a first amplifier having a non-inverting input coupled to the first collector of the first BJT and a first output node configured to provide a bandgap reference voltage, and a first resistor having one terminal coupled to the first output node and another terminal coupled to a first base of the first BJT; and a second closed loop circuit branch comprising:

a second BJT having a second collector configured to receive a second current and a second emitter coupled to ground, a second amplifier having a non-inverting input coupled to the second collector of the second BJT and a second output node coupled to a junction node, a second resistor having one terminal coupled to the junction node and another terminal coupled to a second base of the second BJT, and a third resistor having one terminal coupled to the first base of the first BJT and another terminal coupled to the junction node.

2. The integrated circuit of claim 1, wherein an inverting input of the first amplifier and an inverting input of the second amplifier are configured to receive a bias voltage.

3. The integrated circuit of claim 1, wherein an inverting input of the second amplifier is coupled to the first collector of the first BJT.

4. The integrated circuit of claim 1, wherein an inverting input of the first amplifier is coupled to the first base of the first BJT.

5. The integrated circuit of claim 1, wherein the first resistor comprises a programmable resistor configurable to adjust a level of the bandgap reference voltage provided by the first amplifier.

6. The integrated circuit of claim 5, further comprising a state machine configured to select a particular resistive value of the programmable resistor, wherein the programmable resistor comprises an array of resistors coupled to an array of programmable switches, the state machine is configured to select the particular resistive value from a plurality of resistive values by activation of one or more of the programmable switches, and each of the plurality of resistive values is associated with a respective bandgap reference voltage level provided by the first amplifier.

7. The integrated circuit of claim 1, wherein a resistance value of the second resistor is configured to be equal to a resistive value of the third resistor multiplied by a ratio of the first current to the second current.

8. The integrated circuit of claim 1, wherein a PTAT (proportional-to-absolute-temperature) current that flows through the first resistor is configured to be equal to a difference between a first base-emitter voltage of the first BJT and a second base-emitter voltage of the second BJT, divided by a resistive value of the third resistor.

9. The integrated circuit of claim 1, wherein the bandgap reference voltage is configured to be equal to a difference term multiplied by a gain term, plus a first base-emitter voltage of the first BJT, wherein the difference term is equal to a difference between the first base-emitter voltage and a second base-emitter voltage of the second BJT, and the gain term is equal to a resistive value of the first resistor divided by a resistive value of the third resistor.

10. The integrated circuit of claim 1, further comprising:

current-providing circuitry configured to provide the first and second currents, the current-providing circuitry comprising a fourth resistor having a first terminal coupled to the first collector of the first BJT and a fifth resistor having a first terminal coupled to the second collector of the second BJT, wherein second terminals of the fourth and fifth resistors are tied.

11. The integrated circuit of claim 10, wherein a resistance value of the second resistor is configured to be equal to a resistive value of the third resistor multiplied by a ratio of the fifth resistor to the fourth resistor.

12. The integrated circuit of claim 10, wherein the second terminals of the fourth and fifth resistors are coupled to a bias voltage.

13. The integrated circuit of claim 12, wherein the integrated circuit is implemented as part of a system-on-chip (SOC), and the bias voltage is a power supply voltage on the SOC.

14. The integrated circuit of claim 10, wherein the current-providing circuitry further comprises self-biasing circuitry configured to generate a bias voltage at an inverting input of the first amplifier, the self-biasing circuitry comprising a bias resistor having a first terminal coupled to the inverting input of the first amplifier and a second terminal coupled to the second terminals of the fourth and fifth resistors.

15. The integrated circuit of claim 10, wherein the non-inverting input of the second amplifier is coupled to the collector of the second BJT through a sixth resistor, wherein the sixth resistor is configured to be equal to a resistive value of the third resistor multiplied by a ratio of the fifth resistor to the first resistor.

16. The integrated circuit of claim 10, wherein the second terminals of the fourth and fifth resistors are tied to the first output node of the first amplifier, and the first amplifier has an inverting input coupled to the first base of the first BJT.

17. The integrated circuit of claim 16, wherein a first current at the first collector of the first BJT is configured to be equal to a PTAT (proportional-to-absolute-temperature) current that flows through the first resistor multiplied by a ratio of a resistive value of the first resistor to a resistive value of the fourth resistor, and a second current at the second collector of the second BJT is configured to be equal to the PTAT (proportional-to-absolute-temperature) current multiplied by a ratio of a resistive value of the first resistor to a resistive value of the fifth resistor.

18. The integrated circuit of claim 16, wherein a seventh resistor is coupled between the non-inverting input of the first amplifier and the first collector of the first BJT, an eighth resistor is coupled between the fifth resistor and the non-inverting input of the second amplifier, a ratio of the fifth resistor to the fourth resistor is equal to a ratio of the eighth resistor to the seventh resistor.

19. An apparatus comprising:

a bandgap reference voltage generator comprising:

a first bipolar junction transistor (BJT) having a first collector configured to receive a first current and a first emitter coupled to ground;

a first amplifier having a non-inverting input coupled to the first collector of the first BJT and a first output node configured to provide a bandgap reference voltage;

a first resistor having one terminal coupled to a first base of the first BJT and another terminal coupled to the first output node;

a second BJT having a second collector configured to receive a second current and a second emitter coupled to ground;

a second amplifier having a non-inverting input coupled to the second collector of the second BJT and a second output node coupled to a junction node;

a second resistor having one terminal coupled to a second base of the second BJT and another terminal coupled to the junction node; and a third resistor having one terminal coupled to the first base of the first BJT and another terminal coupled to a junction node.

20. The apparatus of claim 19, further comprising a current-providing circuit to the bandgap reference voltage generator, wherein the current-providing circuit and the bandgap reference voltage generator are implemented as part of a system-on-chip (SOC), the current-providing circuit is coupled to one or more of a current source and a power rail voltage provided by the SOC, and the current-providing circuit is configured to provide the first and second currents to the bandgap reference voltage generator.

21. The apparatus of claim 19, wherein the first resistor comprises a programmable resistor configurable to trim the bandgap reference voltage generator, and the apparatus further comprises a state machine configured to select a particular resistive value of a plurality of resistive values implemented by the programmable resistor.

* * * * *